United States Patent [19]

Wildhaber, Sr.

[11] Patent Number: 4,779,553

[45] Date of Patent: Oct. 25, 1988

[54] AUTOMATIC RUDDER FOR OUTBOARD JET MOTORS

[76] Inventor: Kenneth V. Wildhaber, Sr., 1619 Miller, Jefferson City, Mo. 65101

[21] Appl. No.: 104,334

[22] Filed: Oct. 2, 1987

Related U.S. Application Data

[63] Continuation-in-part of Ser. No. 928,879, Feb. 13, 1987, abandoned.

[51] Int. Cl.[4] ..... B63H 11/10

[52] U.S. Cl. ..... 114/151; 114/144 R; 114/150; 114/128; 114/138

[58] Field of Search ..... 114/144 R, 144 A, 150–152, 114/162–169, 127–128, 138, 141, 145 A; 440/38, 40, 43

[56] References Cited

U.S. PATENT DOCUMENTS

| | | | |
|---|---|---|---|
| 3,465,705 | 9/1919 | Castoldi | 440/43 |
| 3,791,334 | 2/1974 | Wetzel | 440/43 |
| 3,934,538 | 1/1976 | Canazzi | 440/43 |
| 3,976,026 | 8/1976 | Eastling | 440/43 |
| 3,982,494 | 9/1976 | Posti | 440/43 |

*Primary Examiner*—Joseph F. Peters, Jr.
*Assistant Examiner*—Clifford T. Bartz
*Attorney, Agent, or Firm*—Glenn K. Robbins

[57] ABSTRACT

An automatic rudder attachment for outboard jet motors. A rudder attachment is designed to provide steering capability at low or drifting speeds when the jet thrust is reduced and during reverse direction when the jet thrust is reversed. The rudder swings up to a retracted position when the jet motor is operating and provides sufficient thrust for steering. The rudder is pivotally attached over the jet nozzle whereby the water race effects the vertical swing of the rudder.

9 Claims, 1 Drawing Sheet

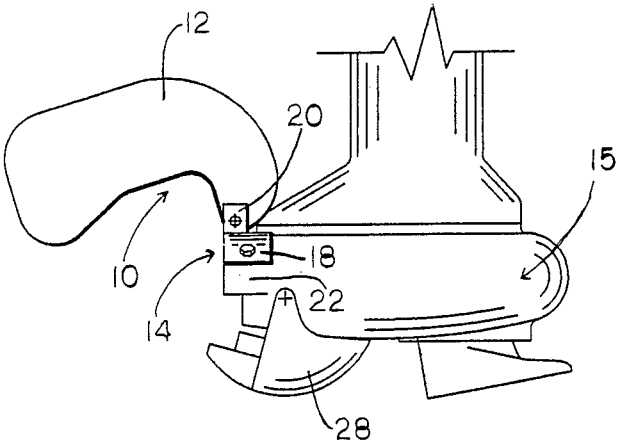
FIG. 1
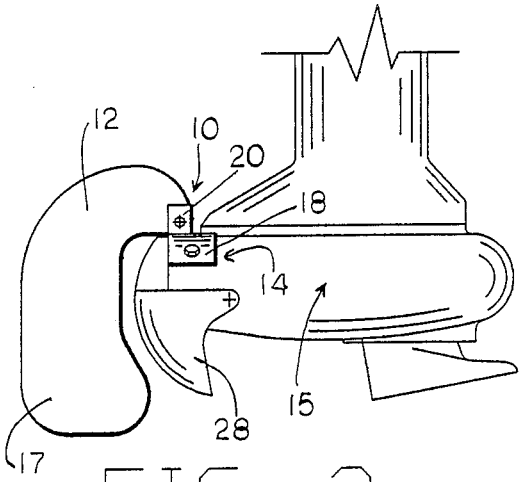
FIG. 2
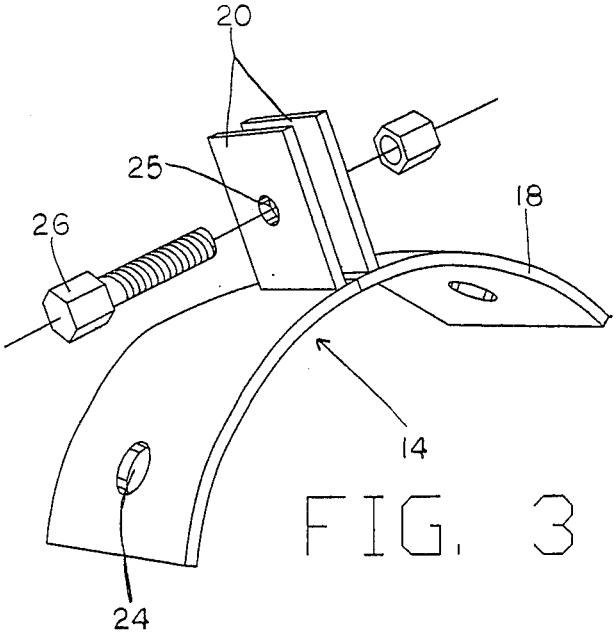
FIG. 3
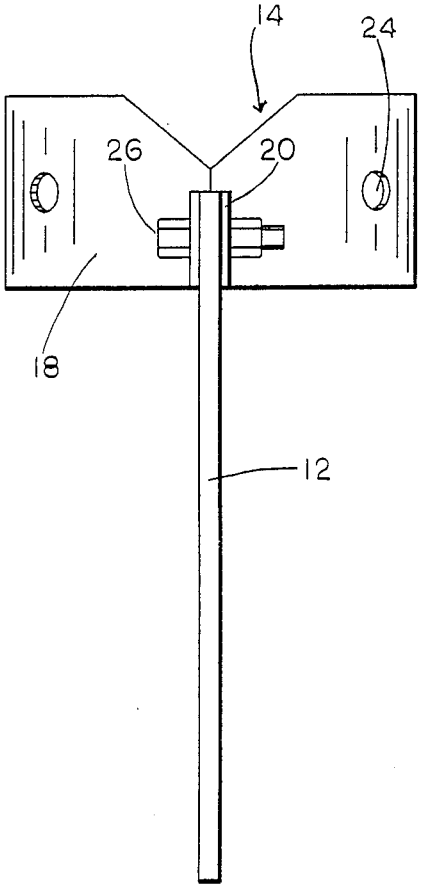
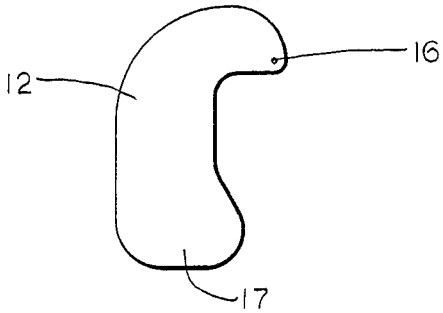
FIG. 4
FIG. 5

AUTOMATIC RUDDER FOR OUTBOARD JET MOTORS

RELATED APPLICATION

This application is a continuation-in-part of my copending application Ser. No. 928,879, filed Feb. 13, 1987, now abandoned.

BACKGROUND OF THE INVENTION

In the operation of an outboard jet motor there exists the problem of steering the craft at low or drifting speeds and when travelling in the reverse direction, When moving at low speeds or drifting, there is insufficient jet race or thrust to propel the craft and when in reverse the jet race is too diffuse to provide an adequate race for propulsion. Therefore, there exists a need to provide a supplementary rudder to aid in directing the course of the craft. A rudder is also more efficient for maneuvering the craft through tight turns.

Although the concepts of rudders and outboard jet motors are old, space limitations generally preclude the employment of both simultaneously. When they have been combined, the purpose of the rudder was generally limited to guiding the jet race rather than primarily guiding the craft. Since the monodirectional thrust of the jet motor is combined with the pivoting characteristics of an outboard motor for steering, the rudder is essentially superfluous during the normal operation of the jet motor at operating speed. However, by not employing a rudder of some sort, control over the direction of the movement of the craft is lost upon low engine or idling speed.

SUMMARY OF THE INVENTION

By means of the instant invention there has been provided an automatic rudder for outboard jet motors. Its purpose is to serve as a supplementary rudder when steering control is lost due to engine cut off or low engine speed. It also enhances steering capabilities when the craft is run in reverse.

The rudder assembly is comprised of two separate elements which are pivotally connected. The rudder itself is a rigid, kidney-shaped plate of metal such as aluminum or steel. This one-piece construction is of a material with sufficiant strength to withstand the stress all rudders are subject to, yet must be lightweight to allow for unhindered retractability. Aluminum lends itself particularly well in this construction.

The base of the rudder assembly is also of similar metallic construction. It is comprised of an arcuate base on the top of which are fixed two opposing vertical bifurcated base plates forming a support yoke of the rudder. The gap between the opposing plates provides a means by which the rudder plate is pivotally connected.

The arcuate base is shaped in a manner to allow it to be easily adapted to the mating arcuate top of the jet nozzle. This places the rudder directly in the path of the jet race. When the jet motor is operating at substantial speed, the jet race displaces the rudder from its effective position. It swings upward about its pivot point to a retracted position above the race where the effects of drag are lessened. When the jet motor is idled down and the jet race is decreased the rudder plate drops back into its effective steering position.

The rudder plate remains in the lowered position when the craft is running in reverse due to the forwardly directed jet race. The means for redirecting the jet race to effect reverse motion of the craft is conventional, per se, as will be well understood.

The object of this invention is to provide a means by which the aspects of an outboard jet motor may be combined with those of a trolling boat and operate when the motor is reversed. This is accomplished through the pivotable rudder which is placed directly in the path of the jet race at low forward speeds and behind the reversed race when in reverse.

It is another object of this invention to provide a rudder that can swing free of underwater obstructions and operate in shallow water.

It is another object of this invention to enable the automatic rudder to remain permanent by tightening the friction bolt at the pivot point.

The above feature are objects of this invention. Further objects will appear in the detailed description which follows and will be further apparent to those skilled in the art.

For the purpose of illustration of this invention, a preferred embodiment thereof is shown in the accompanying drawing. It is to be understood that the drawing is for purpose of description only and that the invention is not limited thereto.

IN THE DRAWINGS

FIG. 1 is a view in side elevation of the automatic rudder attachment as it is employed on the outboard jet motor, showing the rudder in its retracted position during operation of the motor at medium to high speed;

FIG. 2 is a view similar to FIG. 1 showing the rudder in its operable position, having dropped down as the jet race is forwardly directed to effect reverse movement of the boat;

FIG. 3 is an enlarged pictorial view of the arcuate base piece;

FIG. 4 is a view in right side elevation of the kidney-shaped rudder; and

FIG. 5 is an enlarged top plan view of the rudder as it is attached to the arcuate base piece.

DESCRIPTION OF THE INVENTION

The automatic rudder attachment of this invention is generally indicated by reference numeral 10 as shown in FIGS. 1 and 2. It is comprised of two separate pieces; the rudder 12 and base 14 attached to a jet motor 15.

The rudder 12 is a one piece vertical plate construction. It is kidney-shaped or L-shaped and rigid, being constructed of metal. The rudder has a single hole 16 best shown in FIG. 4 by which it is pivotally attached to base 14.

The bottom 17 of the rudder extends slightly below the lower most portion of the jet motor 15 in order that in shallow water it is pivoted or first contacted by an obstruction to alert the operator and avoid damage to the motor. The rudder is balanced by the top offset portion at the pivot connection to the base such that at low or no speed the rudder falls by its own weight to the lowered position of FIG. 2.

Base 14 is essentially a two piece metal construction best shown in FIGS. 3 and 5. It is comprised of two arcuate base plates 18 and two opposing vertical plates 20 connected to the two base plates. Base plates 18 are arcuate to enable them to be anchored atop the circular jet nozzle 22. The plate is provided with holes 24 to accomodate anchoring bolts which may be secured to tapped holes (not shown) in the top of the jet nozzle.

Vertical plates 20 are spaced apart to provide a yoke to accept the rudder attachment. Each of the vertical plates is equipped with ahole 25 receiving a bolt 26 to connect the rudder in a pivot attachment to the plates 20 forming the yoke. The base plates and vertical plates are shown preferably constructed in two separate pieces for ease in construction, such as by casting, but it will be understood that a single integral unit may be employed such as by a more difficult casting, welding or the like.

USE

The automatic rudder attachment is very simply employed on outboard jet motors. The base piece 14 easily attaches atop the circular jet nozzle 22 which places the connected rudder 12 directly in the path of the water race emanating from the nozzle.

When the jet motor is operating in the forward thrust mode at medium or high speeds, the water race pushes the lower tail of the rudder upward thereby pivoting the rudder into its retracted position as best shown in FIG. 1. Drag on the boat is diminished when the rudder is retracted.

Jet motors depend on thrust in order to steer in the desired direction as the motor and race are pivoted. As is often the case, one may wish to run at low speeds or merely to drift or coast.

As the motor is idled down, the jet thrust is weakened and becomes diffuse and the guiding effect is lost. The rudder, due to the decrease in the jet race, drops back into its lowered position and provides steering capability.

The hinged attachment of the rudder on the base allows free movement in the event the rudder encounters underwater obstructions. This prevents the rudder from being damaged and also indicates to the operator the presence of such obstructions, as in the case of shallow water.

The automatic rudder attachment also provides steering capabilites when the jet motor is operating in reverse. As is conventional, jet motors are equipped with a reversing mechanism 28 in the form of a reversing baffle which hangs free of the jet nozzle when the boat is being propelled forward as in FIG. 1. When reverse propulsion is desired, the reversing mechanism is raised over the jet nozzle opening whereby the water race is forwardly diverted as shown in FIG. 2. This results in a diffuse forward thrust whereby steering capabilities are hampered. However, because the jet thrust is now diverted, the rudder will drop back into the lowered position and reverse steering control is obtained.

If desired, the rudder 12 may be restricted to its effective position with no pivotal movement by sufficiently tightening bolt 26. The vertical plates 20 will clamp down on the rudder and hold it in place.

Various changes and modifications may be made within this invention as will be apparent to those skilled in the art. Such changes and modifications are within the scope and teaching of this invention as defined in the claims appended hereto.

What is claimed is:

1. A rudder for an outboard jet motor provided with an outboard jet nozzle pivotal about a vertical axis, said rudder extending in a vertical plane to provide for steering laterally in a body of water and being provided with a base, means for attaching said base to said motor, said rudder further comprising a rudder member attached to said base to provided for pivoting about a horizontal axis at a forward portion of said rudder and being restricted from pivoting on said base about a vertical axis, said rudder member by its own weight and force of gravity being moveable from an upward postiion to a lowered position substantially behind the outlet port of said jet nozzle in axial alignment with a central portion of the outlet port of the jet nozzle when said jet motor is not operating and at low forward speeds and being upwardly pivotable at medium and high speeds when the jet race is of sufficient velocity to move the rudder upwardly.

2. The rudder of claim 1 in which said base comprises an arcuate base plate secured to a top portion of said jet nozzle and a yoke receiving a top portion of said rudder member in pivotal relation about a horizontal axis.

3. The rudder of claim 1 in which said rudder member has an arcute configuration and is pivotally attached to the base at a top offset forward position with a major portion of the rudder member extending to the rear of the jet nozzle providing a center of gravity to the rear of the jet nozzle whereby when thre is no jet race and at low jet race speed of said jet motor when the jet race is of limited velocity said rudder member pivots by its own weight to a lowered operative steering position substantially behind the outlet port of the jet nozzle to provide an enhanced steering capability when the jet motor is pivoted to effect steering.

4. The rudder of claim 3 in which said rudder member has a bottom portion extending slightly below a bottom portion of said motor and is automatically pivoted upwardly upon encountering shallow water bottom or other obstructions at depths sufficiently shallow to provide contact with the rudder and sufficiently deep that the motor does not contact the obstruction.

5. The rudder of claim 1 in which said rudder is positioned behind a reversing baffle which is connected to said jet motor and is moveable into and out of engagement with said jet race behind said jet nozzle, said rudder being automatically pivoted to the lowered position by its own weight when the jet outboard motor is reversed to direct forwardly the jet motor race.

6. The rudder of claim 2 in which said base plate is comprised of two half sections each of which is connected to an upstanding vertical plate, said base plates being separately nestable upon and attachable to the top portion of the jet nozzle and said vertical plates being spaced from one another and forming the yoke.

7. The rudder of claim 1 in which said base comprises an arcuate base plate secured to a top portion of said jet nozzle and a yoke receiving a top portion of said rudder member in pivotal relation and said rudder member has a flat arcuate plate-like configuration extending in a vertical plane and is pivotally attached to the base at a top offset forward position with a major portion of the rudder member extending to the rear of the jet nozzle whereby when there is no jet race and at low jet race speed said rudder member pivots by its own weight to an operative steering position substantially behind the outlet port of the jet nozzle to provide an enhanced steering capability when the jet motor is pivoted to effect steering.

8. The rudder of claim 7 in which said rudder member has a bottom portion extending slightly below a bottom portion of said motor and is automatically pivoted upwardly upon encountering shallow water bottom or other obstructions at depths sufficiently shallow to provide contact with the rudder and sufficiently deep that the motor does not contact the obstruction.

9. The rudder of claim 1 in which the rudder in said lowered postiion behind the outlet port of the jet nozzle is also positioned behind a jet motor reversing baffle, said reversible baffle being mounted on said motor for movement between said rudder when lowered and the jet nozzle and away therefrom, and out of contact with both said rudder and jet nozzle.

* * * * *